United States Patent [19]

Miller

[11] Patent Number: 4,779,294

[45] Date of Patent: Oct. 25, 1988

[54] PROTECTIVE STRUCTURE

[76] Inventor: Gary D. Miller, 3957 Maricarr Dr., Kettering, Ohio 45429

[21] Appl. No.: 62,723

[22] Filed: Jun. 15, 1987

[51] Int. Cl.[4] ..... A47C 29/00

[52] U.S. Cl. ..... 5/414; 248/165

[58] Field of Search ..... 248/165; 5/414, 508; 135/93, 108, 107, 109, 106, 101

[56] References Cited

U.S. PATENT DOCUMENTS

| | | | |
|---|---|---|---|
| 364,415 | 6/1887 | Hooper | 5/414 X |
| 493,305 | 3/1893 | Sherman | 135/108 X |
| 598,098 | 2/1898 | Ivy | 135/108 X |
| 1,021,930 | 4/1912 | Jackson | 5/414 X |
| 2,699,794 | 1/1955 | Potter | 5/414 |
| 4,069,527 | 1/1978 | Harris | 5/414 |
| 4,406,437 | 9/1983 | Wright | 248/529 |

*Primary Examiner*—J. Franklin Foss

*Attorney, Agent, or Firm*—Joseph P. Burke

[57] ABSTRACT

This disclosure is directed to a steel tubular protective structure capable of deflecting and/or resisting impact from falling objects and retaining same and comprising a lower assembly and an upper assembly. The lower assembly is comprised of at least four steel tubular legs positioned between flange-shaped metal feet and steel sleeves and joined by said sleeves to the upper assembly. The upper assembly contains a plurality of substantially parallel tubular steel main structural members defining the length of the tubular protective structure and the external diameter of the downward facing portions of which define the internal diameter of the upper portion of said sleeves. A plurality of tubular steel end cross members join the main structural members near the locations of adjacent pairs of the legs. The upper assembly also includes a plurality of tubular steel intermediate cross members substantially parallel with end members and joined to the main structural members on the inward aspect thereof. Located between these end cross members are one or more secondary tubular steel structural members each of which are substantially parallel to the main structural members and joined to the end cross members and intermediate cross members.

9 Claims, 1 Drawing Sheet

PROTECTIVE STRUCTURE

The present invention is directed to a steel tubular protective structure capable of deflecting and/or resisting impact from falling objects and retaining same and comprising a lower assembly and an upper assembly. The lower assembly is comprised of at least four tubular steel legs positioned between flange-shaped metal feet and steel sleeves and joined by said sleeves to the upper assembly. The upper assembly contains a plurality of substantially parallel tubular steel main structural members defining the length of the tubular protective structure and the external diameter of the downward facing portions of which define the internal diameter of the upper portion of said sleeves. A plurality of tubular steel end cross members join the main structural members near the locations of adjacent pairs of the legs. The upper assembly also includes a plurality of tubular steel intermediate cross members substantially parallel with end members and joined to the main structural members on the inward aspect thereof. Located between these end cross members are one or more secondary tubular steel structural members each of which is substantially parallel to the main structural members and joined to the end cross members and intermediate cross members.

The steel tubular protective structure of this invention is further characterized as being separate and apart from the structure it encompasses, i.e., a bed or crib, and as having a length and width exceeding same.

BACKGROUND OF THE INVENTION AND PRIOR ART

Earthquakes and tornadoes have taken thousands of human lives and caused severe injuries and suffering all over the world. While many of these deaths and injuries are not preventable, many deaths and injuries occur while the missing or injured person is asleep at home in his/her own bed. Many of these casualties occur in one, two or three story buildings. Typically these injuries and deaths are caused by falling objects which are internal to the house or apartment structure in which the casualty is sleeping. Ceilings and floors cave in and parts of the structure located above the sleeping casualty descend by gravity, due to natural calamities, hurricane, earthquake, tornado or other forces upon the unwary sleeping persons.

The present invention is structured so as to reduce or minimize the hazards from falling objects to sleeping persons during earthquakes and tornadoes.

Various canopies have been proposed in the prior art for beds, other sleeping compartments and shelters of varying types.

U.S. Pat. No. 493,305 issued to Sherman is directed to an adjustable ventilating canopy frame for beds. The main purpose of the canopy is to provide a simple frame embodying in its construction an adjustable ventilating fan. Hence this canopy is designed for the comfort of the person sleeping in the bed. The Sherman patent is characterized by having its upright members secured to the bed frame, itself. Thus it will be observed that the Sherman ventilating canopy is co-extensive with the bed, both in length and width.

U.S. Pat. No. 326,437 issued to Marsh is directed to a bed screen frame which is attached interiorly within the perimeter of the bed. The purpose of the Marsh adjustable frame is for the purpose of supporting screens of mosquito-netting and the like. The Marsh frame may be removed from the bed during seasons of the year when the suitable mosquito-netting or screen is not required.

U.S. Pat. No. 1,404,485 issued to Shellady is directed to a collapsible sleeping compartment whose object is to provide a compartment which can be set up readily to provide an enclosure containing a bed and a chair which constitute portions of a collapsible structure, thereby permitting a number of persons to occupy the same room, yet each person would have the privacy of a separate room. It will be observed that the purpose of the Shellady collapsible sleeping compartment is privacy and it does not protect from falling objects. Moreover, it will be observed that both the bed portion of the Shellady frame and the chair portion thereof are located within the perimeter of the Shellady compartment or canopy and the bed and chair are a portion of the Shellady collapsible sleeping compartment, whose portions actually constitute the surfaces on which a person may sleep or sit.

U.S. Pat. No. 2,362,567 issued to La Rue is directed to a knockdown picnic table with a canopy-supporting structure embodied therein. The embodiment of FIG. 1 of La Rue can be employed as a picnic table whereas the embodiment of FIG. 2 thereof can be employed as a bed upon removal of the canopy supporting frame. It will be observed that in both cases the La Rue structure forms a part of and is within the same perimeter as the bed upon which the person would sleep or the picnic table at which the person would sit.

U.S. Pat. No. 2,690,186 issued to Ball is directed to a canopy support for cots. It will be observed that the Ball supporting structure is designed for supporting a mosquito netting or tent over a camper's cot and is attached to the upper portion of the cot structure, itself.

U.S. Pat. No. 2,928,405 issued to Lawson is directed to a portable shelter in the form of an easily erected and collapsed canopy or covering adapted for use to protect against sun, rain or snow, and provide a beach shade, picnic shelter, tent lean-to, patio shade, shade for children's play pen, shade for a bathing pool, baby carriage and the like, or a shade for a boat. The Lawson portable shelter can also be used as a carport. The Lawson canopy consists of a sheet of pliable material, such as canvas or the like, having about its periphery a plurality of metal eyelets. This canopy is then supported by fasteners mounted to vertical support posts whose length can be variably positioned by apertures and pins.

U.S. Pat. No. 4,541,445 issued to Ferguson is directed to a tent, e.g., used for camping, comprising end walls of trapezoidal shape and pole structures which support the tent via the tops of its end walls. The pole supporting structure is for the purpose of giving shape to and supporting the tent fabric.

DETAILED DESCRIPTION OF THE INVENTION

Figure 1:
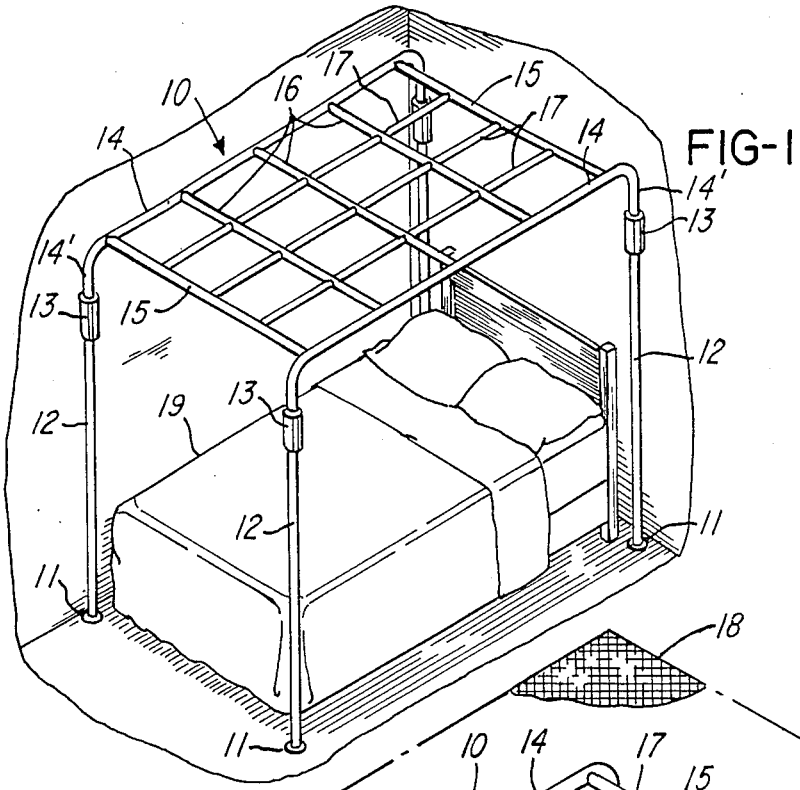
FIG. 1 of the drawing is a perspective view showing the steel tubular protective structure of this invention, positioned so as to emcompass yet exceed the length and width dimensions of a separate bed or crib positioned thereunder.

As will be apparent from FIG. 1 of the drawing, the steel tubular protective structure 10 of this invention has four steel tubular legs 12 positioned at the four corners of the protective structure. Legs 12 are located between flange-shaped metal feet 11 and the lower portion of steel tubular sleeves 13, with the feet 11, legs 12 and sleeves 13 completing the lower assembly of the steel tubular protective structure.

The upper portion of the steel tubular protective structure contains a plurality of substantially parallel steel tubular main structural members 14 (one for each pair of legs 12) defining the length of said structure. The external diameter of the vertical downward facing portions 14' define the internal diameter of the upper portion of said sleeves. Each main structural member has a horizotal portion 14 and a pair of vertical portions 14'. Preferably the horizontal and vertical portions are integral to form one piece. A plurality of steel tubular end crossing members 15 join the main structural members 14 near the locations of the respective pairs of legs at both ends of said structure.

A plurality of intermediate steel tubular cross members 16 substantially parallel with the end crossing members 15 are joined to the main structural members 14 on the inward aspect thereof and are located between the end crossing members 15. The upper assembly structure is completed by one or more secondary steel tubular structural members 17 positioned substantially parallel to the main structural members 14 and joined to the end cross members 15. It will also be observed that these secondary steel structural members 17 may pass through one or more of the intermediate cross members 16. Alternatively, they can be welded, joined by adhesive or threadably engaged between end members 15 and cross members 16 and between cross members 16, themselves.

Each metal foot 11 is attached to its leg 12 by friction, threaded engagement, adhesive or comparable union. These metal feet can be made of steel, cast iron, aluminum and metal alloys. The purpose of these feet is to transmit the weight of the protective structure to the surface, e.g., the floor on which it rests.

Figure 2:
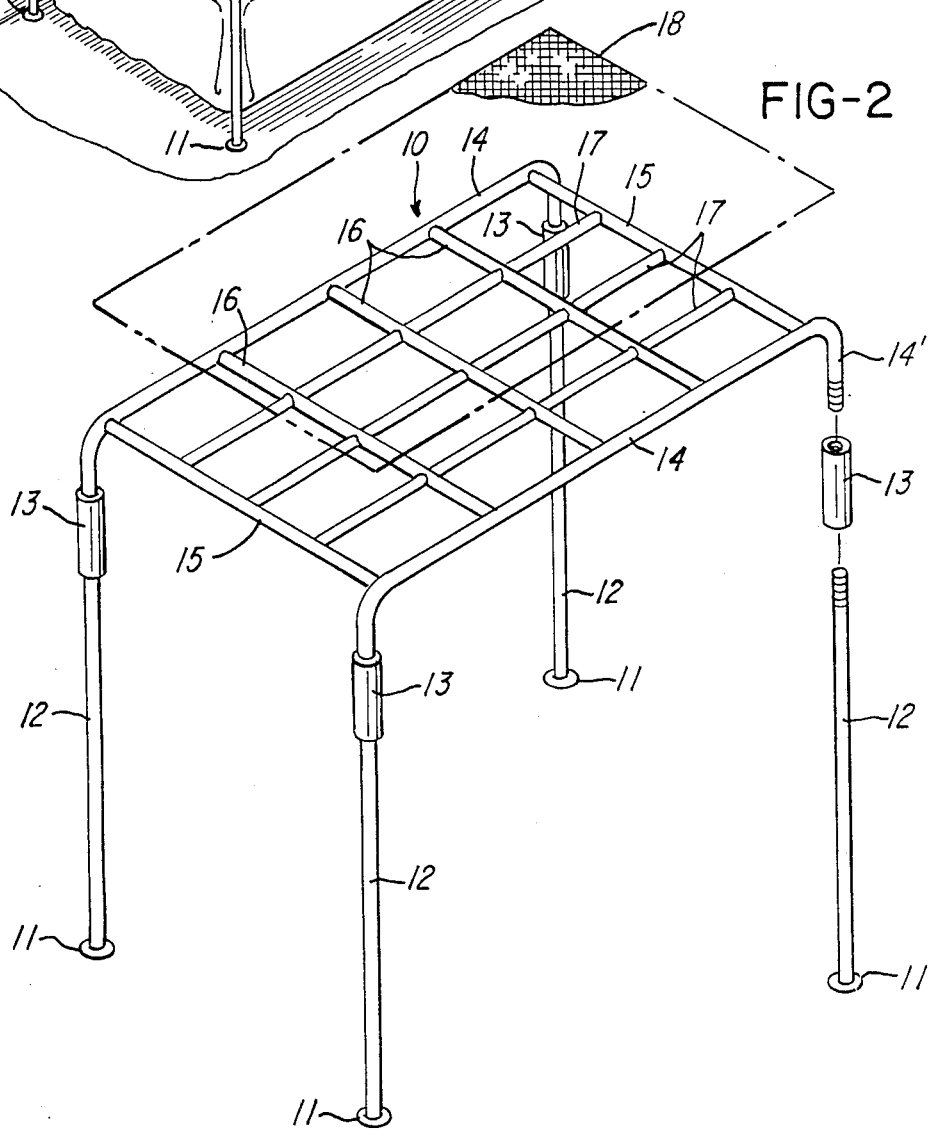
FIG. 2 of the drawings is an isometric view illustrating the present invention in conjunction with an optional screen or mesh member intended for attachment to the upper part of the upper assembly.

There are four or more legs 12 which support the upper assembly of the tubular structure 10. Legs 12 are of sufficient height in conjunction with vertical portions 14' and sleeves 13 to allow access to the underside of the structure 10 so that the person can readily gain access to the bed 19. According to one embodiment of this invention, each leg 12 can be threaded (FIG. 2) at its upper end to allow for assembly with sleeves 13 and also to facilitate minor adjustments in height of said protective structure. Each leg 12 has its own steel sleeve 13. Sleeves 13 can be threaded interiorly to allow for attachment not only to its legs 12, but also to the lower vertical 14' portion of the main structural member 14. This threading also allows for height adjustment for both legs 12 and major structural members 14. Alternatively, the sleeves 13 can have a fairly tight slip fit over legs 12 and over the downward facing portion 14' of the main structural members 14 to which sleeves 13 attach. Other forms of attachment of the sleeves to the main structural members 14 can be by welding, adhesive, friction fit, etc.

There are at least two main tubular structural members 14. They are made of steel and determine the length of the tubular protective structure. Together with the end cross pieces 15, intermediate cross pieces 16 and secondary structural members 17, the main structural members 14 provide a strong tubular structure for deflecting and/or resisting impact from and retaining large falling objects, such as would be produced during an earthquake. By deflecting and/or resisting impact from and retaining such falling objects, the steel tubular protective structure of this invention serves to protect the person sleeping in the bed, crib or other separate structure positioned within the perimeter of and underneath upper assembly of the steel tubular protective structure 10.

Cross pieces 16 and end cross members 15 are of steel and run between the main structural members 14. End members 15 and some of cross pieces 16 are attached to the main structural members 14, preferably by welding. The angle between the main structural members 14 and the portions of end members 15 and cross pieces 16 at the point of attachment, usually approximates 90 degrees.

Overhead protective element 18, e.g., heavy wire mesh screening (FIG. 2), can be attached to the upper assembly members 14, 15, 16 and 17, e.g., by welding, metal rings, adhesive, etc., at appropriate locations, to stop and retain smaller chunks of falling debris, thereby further protecting the person(s) on bed 19 below. Such screening can have openings ranging in size from about 0.5 square inch to about 144 square inches, and is capable of retaining pieces generating up to 150 foot pounds. Alternatively tightly woven or non-woven ballistic fabric can be employed to constitute overhead protective element 18. The ballistic fabric can be made of ballistic nylon, "Kelvar", glass fibers, various combinations of such fibers, etc., such as are presently in use for bullet-proof vests. Ballistic fabric overhead protective element 18 can be attached or secured to the upper assembly of protective structure 10 by adhesive, clamps, lacings, plastic strips, etc.

Secondary structural members 17 are preferably attached at their ends to the end of cross members 15 and at the intermediate cross members 16 by welding.

The steel tubes suitable for use in the protective structure of this invention have impact resisting strengths to resist falling objects having downward forces which range from about 1000 foot pounds to about 10,000 foot pounds, and more usually range from about 1000 foot pounds to about 8,000 foot pounds.

While the preceding discussion has referred to the use of the steel tubular protective structure 10 of the present invention, primarily as it pertains to beds or cribs, this steel tubular protective structure can also be used to protect other places where people lie, sit and congregate while they are not sleeping.

I claim:

1. A steel tubular protective structure capable of deflecting and/or resisting impact from falling objects and retaining same comprising a lower assembly of at least four steel tubular legs positioned between flange-shaped metal feet and steel sleeves and joined by said sleeves to an upper assembly containing a plurality of substantially parallel steel main tubular structural members defining the length of said structure and the external diameter of the downward facing portions of which define the diameter of the upper portion of said sleeves; a plurality of tubular steel end cross members joined to said main structural members near the locations of adjacent pairs of said legs; a plurality of steel intermediate tubular cross members substantially parallel to said end cross members and joined to said main structural members on the inward aspect thereof and located between said end cross members; and one or more secondary tubular steel structural members substantially parallel to said main structural members and joined to said end cross members and said intermediate cross members; said steel tubular protective structure being further characterized as separate and apart from the protected structure beneath it and having a length and width exceeding same.

2. A protective structure as in claim 1 including an overhead protective element attached to said upper assembly.

3. A protective structure as in claims 1 or 2 wherein said main structural members, end cross members, intermediate cross members and secondary structural members are attached by welding.

4. A protective structure as in claims 1 or 2 wherein each flange-shaped metal foot is attached to its respective leg by threaded engagement therewith.

5. A protective structure as in claims 1 or 2 wherein each sleeve is joined to the downward facing portions of its main structural member by threaded engagement.

6. A protective structure as in claims 1 or 2 wherein the upper portion of each leg is threadably engaged with the lower portion of its respective sleeve.

7. A protective structure as in claim 2 wherein said overhead protective element is heavy wire mesh screening.

8. A protective structure as in claim 7 wherein said heavy wire mesh screening has openings ranging in size from about 0.5 square inch to about 144 square inches.

9. A protective structure as in claim 2 wherein said overhead protective element is tightly woven or non-woven ballistic fabric.

* * * * *